US010863838B2

(12) United States Patent
Davis et al.

(10) Patent No.: US 10,863,838 B2
(45) Date of Patent: Dec. 15, 2020

(54) CUSHION APPARATUS HAVING A RESILIENT SPRING MEMBER

(71) Applicant: BANYAN LICENSING L.L.C., Charlotte, NC (US)

(72) Inventors: Edmund Scott Davis, Clover, SC (US); Keith Coponi, Davie, FL (US); Calvin Tabor, Charlotte, NC (US)

(73) Assignee: Banyan Licensing L.L.C., Vero Beach, FL (US)

( * ) Notice: Subject to any disclaimer, the term of this patent is extended or adjusted under 35 U.S.C. 154(b) by 169 days.

(21) Appl. No.: 15/572,117

(22) PCT Filed: May 4, 2016

(86) PCT No.: PCT/US2016/030824

§ 371 (c)(1),
(2) Date: Nov. 6, 2017

(87) PCT Pub. No.: WO2016/179311

PCT Pub. Date: Nov. 10, 2016

(65) Prior Publication Data

US 2018/0140101 A1 May 24, 2018

Related U.S. Application Data

(60) Provisional application No. 62/157,338, filed on May 5, 2015.

(51) Int. Cl.
*A47G 9/10* (2006.01)
*A47C 27/06* (2006.01)
(Continued)

(52) U.S. Cl.
CPC ..... *A47G 9/1009* (2013.01); *A47C 7/021* (2013.01); *A47C 7/746* (2013.01); *A47C 27/065* (2013.01); *A47C 27/22* (2013.01); *A47G 9/10* (2013.01)

(58) Field of Classification Search
CPC ..... A47C 7/746; A47C 7/021; A47C 7/383; A47C 27/065; A47C 27/22; A47C 3/16;
(Continued)

(56) References Cited

U.S. PATENT DOCUMENTS 924,893 A * 6/1909 Doddridge ..... A47G 9/10 5/491
2,877,472 A * 3/1959 Wagner ..... A47G 9/10 5/636

(Continued)

FOREIGN PATENT DOCUMENTS

WO 2015015324 A1 2/2015
WO WO-2015015324 A1 * 2/2015 ..... A47G 9/10

OTHER PUBLICATIONS

International Search Report for International Patent Application No. PCT/US2016/030824 dated Aug. 5, 2015.

(Continued)

*Primary Examiner* — David R Hare
(74) *Attorney, Agent, or Firm* — Moore & Van Allen PLLC; Henry B. Ward, III

(57) ABSTRACT

Embodiments of the invention relate to a cushion apparatus comprising a resilient spring member. Typically, the cushion apparatus in configured to provide flexible support to a user, allow air circulation through and within the cushion apparatus and allow ventilation of excess heat. In some embodiments, the cushion apparatus comprises a resilient spring member and a cushion cover member at least partially enclosing the spring member. In some embodiments, the cushion cover member is structured to be removable attached to the resilient spring member.

13 Claims, 8 Drawing Sheets

(51) Int. Cl.
*A47C 27/22* (2006.01)
*A47C 7/02* (2006.01)
*A47C 7/74* (2006.01)

(58) Field of Classification Search
CPC ..... A47G 9/10; A47G 9/1009; A47G 9/1036; A47G 9/1072; A47G 9/1081; A47G 9/109; A47G 2009/1018
See application file for complete search history.

(56) References Cited

U.S. PATENT DOCUMENTS 2,910,707 A * 11/1959 Lawser ..... A45C 3/10 5/419
3,378,860 A * 4/1968 Frazier ..... A47C 27/16 5/491
4,007,503 A * 2/1977 Watkin ..... A47G 9/10 5/490
4,230,365 A * 10/1980 Messinger ..... A47C 3/00 297/447.1
5,148,564 A * 9/1992 Reder ..... A47G 9/0253 5/490
5,214,816 A * 6/1993 Collins ..... A47C 16/005 5/633
5,216,771 A * 6/1993 Hoff ..... A47C 20/021 5/490
5,535,468 A * 7/1996 Mallernee ..... A47G 9/10 5/638
5,604,944 A * 2/1997 Meade ..... A47G 9/1009 5/636
D394,977 S * 6/1998 Frydman ..... A47G 9/10 D6/596
5,824,013 A * 10/1998 Allen ..... A47C 7/425 606/240
5,907,876 A * 6/1999 Schwabe ..... A47G 9/10 5/636
6,041,458 A 3/2000 Vickers et al.
6,154,904 A * 12/2000 Ehredt ..... A45C 3/10 5/639
D448,228 S * 9/2001 Davis ..... D6/601
6,578,218 B2 * 6/2003 Wassilefsky ..... A47C 20/021 5/630
7,131,156 B1 * 11/2006 Walker-Craft ..... A47G 9/1045 5/655
7,216,387 B2 * 5/2007 Laxton ..... A47G 9/1009 5/485
7,426,764 B2 * 9/2008 Ekins ..... A47C 7/383 5/640
D582,611 S * 12/2008 Bise ..... A47C 1/143 D30/118
D654,770 S * 2/2012 Frank ..... A47G 9/10 D8/40
8,316,489 B1 * 11/2012 Leal ..... A47G 9/1009 5/640
8,695,135 B2 * 4/2014 Berube ..... A47C 7/425 5/630
D739,616 S * 9/2015 Elliott ..... A47C 3/00 D30/160
9,782,009 B2 * 10/2017 Backer ..... A47C 7/46
9,943,180 B2 * 4/2018 Hsu ..... A47G 9/1081
10,178,914 B2 * 1/2019 Trucco ..... A47C 16/00
10,244,877 B2 * 4/2019 Bradshaw ..... A47G 9/10
2007/0188006 A1 * 8/2007 Zahner, III ..... A47C 1/143 297/451.7
2010/0043147 A1 * 2/2010 Popp ..... A47D 13/083 5/636
2012/0117733 A1 * 5/2012 Chen ..... A47G 9/1009 5/652.1

OTHER PUBLICATIONS

Written Opinion for International Patent Application No. PCT/US2016/030824 dated Aug. 5, 2016.

* cited by examiner

CUSHION APPARATUS HAVING A RESILIENT SPRING MEMBER

CROSS-REFERENCE TO RELATED APPLICATION

This application claims priority to U.S. Provisional Application No. 62/157,338, filed May 5, 2015, entitled "Cushion Apparatus Having a Resilient Spring Member," the contents of which are hereby incorporated by reference in its entirety.

FIELD OF THE INVENTION

The present invention relates, in general, to a cushion apparatus for providing flexible support to a user. Specifically, the present invention relates to a resilient cushion that is configured to allow air circulation and ventilation of excess heat.

BACKGROUND

A pillow or cushion is generally useful for the purpose of rendering comfort and/or support to a user. Conventional pillows are manufactured using "pillow-filling material" such as high resilient ("HR") urethane foam formed by conventional molding processes for providing the desired density and stability to the foam. However, these pillows are expensive, retain body heat, and eventually lose their resilient foam property with continuous use. There is a need for an inexpensive, breathable pillow capable of retaining its structural resiliency for an extended period of time.

BRIEF SUMMARY

Embodiments of the invention are directed to a cushion apparatus, comprising: a resilient spring member, the resilient spring member comprising a first surface, a second surface, and a left-lateral surface, wherein the first surface, second surface, and left-lateral surface define an interior hollow; and a cushion cover member at least partially enclosing the spring member.

In some embodiments, the cushion apparatus further comprises a right-lateral surface, and wherein the first surface, second surface, left-lateral surface and right-lateral surface define the interior hollow.

In some embodiments or in combination with the previous embodiment, at least one of the first surface, second surface, and left-lateral surface define at least one aperture.

In some embodiments or in combination with any of the previous embodiments, the resilient spring member is formed of plastic.

In some embodiments or in combination with any of the previous embodiments, the resilient spring member is formed of metal.

In some embodiments or in combination with any of the previous embodiments, the cushion apparatus further comprises one or more reinforcing members positioned within the interior hollow.

In some embodiments or in combination with any of the previous embodiments, the resilient spring member comprises a contoured indentation along at least one of the first surface and the second surface, wherein the contoured indentation extends into the interior hollow.

In some embodiments or in combination with any of the previous embodiments, the resilient spring member defines a cushion height between the first surface and the second surface, wherein the cushion height varies along a length of the resilient spring member.

In some embodiments or in combination with any of the previous embodiments, the cushion cover member comprises at least one cover aperture configured to allow access to the interior hollow of the resilient spring member.

In some embodiments or in combination with any of the previous embodiments, the cushion cover member is at least partially attached to one or more of the first surface, second surface, and left-lateral surface.

In some embodiments or in combination with any of the previous embodiments, the cushion cover member comprises spacer fabric.

In some embodiments or in combination with any of the previous embodiments, the cushion cover member comprises high-resilient urethane foam.

In some embodiments or in combination with any of the previous embodiments, the cushion apparatus further comprises a cover at least partially enclosing the cushion cover member and the resilient spring member.

In some embodiments or in combination with any of the previous embodiments, the cushion apparatus is configured to allow heat transfer from an exterior of the cushion apparatus to the interior hollow.

In some embodiments or in combination with any of the previous embodiments, the cushion apparatus is configured to allow circulation of air within the cushion apparatus and ventilation of heat away from the cushion apparatus.

To the accomplishment of the foregoing and related ends, the one or more embodiments comprise the features hereinafter fully described and particularly pointed out in the claims. The following description and the annexed drawings set forth in detail certain illustrative features of the one or more embodiments. These features are indicative, however, of but a few of the various ways in which the principles of various embodiments may be employed, and this description is intended to include all such embodiments and their equivalents.

The features, functions, and advantages that have been discussed may be achieved independently in various embodiments of the present invention or may be combined with yet other embodiments, further details of which can be seen with reference to the following description and drawings.

BRIEF DESCRIPTION OF THE DRAWINGS

The foregoing and other advantages and features of the invention, and the manner in which the same are accomplished, will become more readily apparent upon consideration of the following detail description of the invention taken in conjunction with the accompanying drawings, which illustrate preferred and exemplary embodiments and which are not necessarily drawn to scale, wherein.

DETAILED DESCRIPTION OF AN EMBODIMENT OF THE INVENTION

The present invention now will be described more fully hereinafter with reference to the accompanying drawings, in which some, but not all embodiments of the invention are shown. This invention may be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
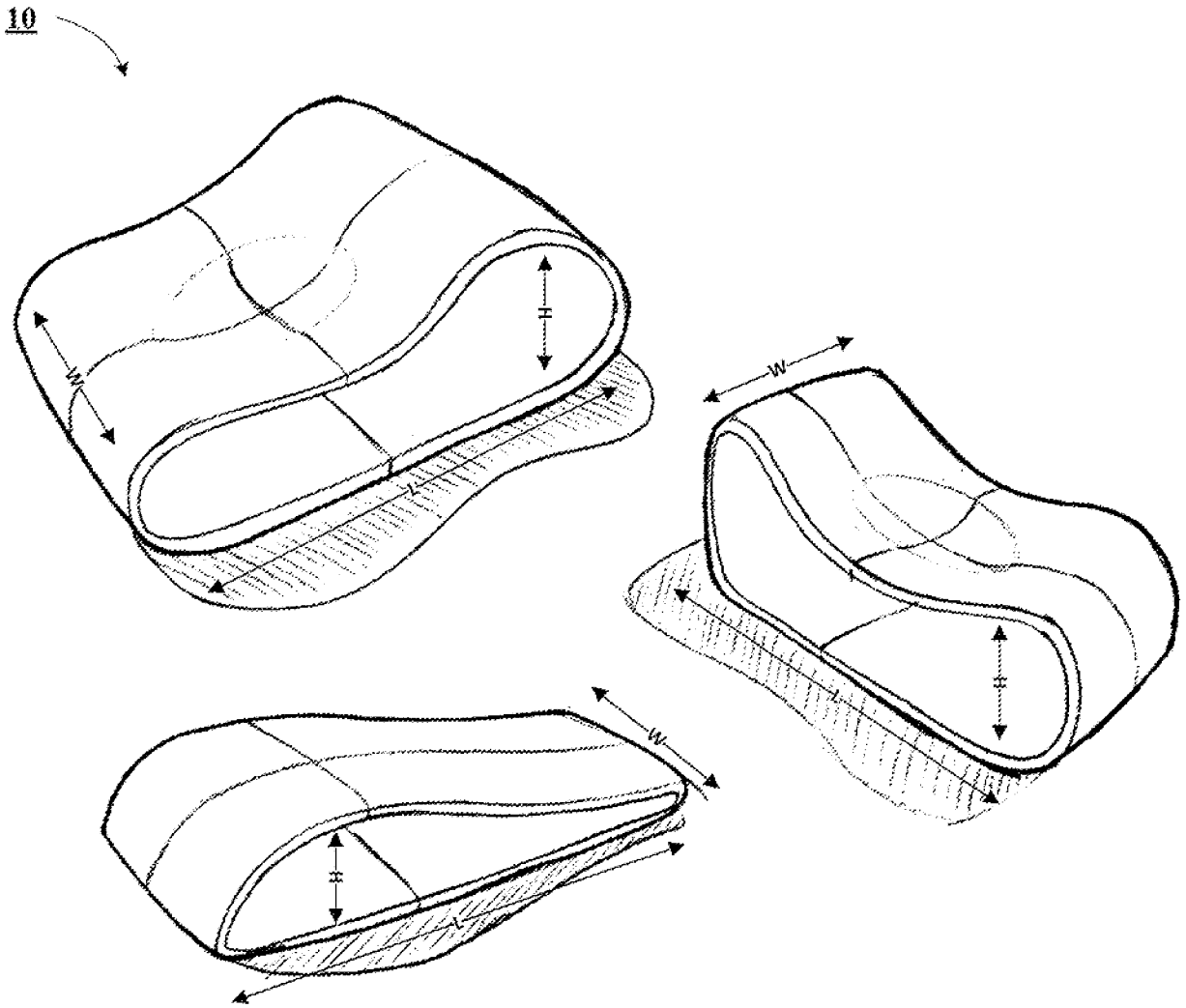
FIG. 1 illustrates a perspective view of a cushion apparatus, in accordance with one embodiment of the invention.

Embodiments of the invention are directed to a cushion apparatus 10 pillow to provide ergonomic pressure relief for a user. The cushion apparatus 10 of the present invention that is configured to provide flexible support to the user and also configured to allow air circulation within the cushion apparatus and ventilation of excess heat. In one embodiment, the cushion apparatus 10 comprises a resilient spring member 20 as the core of the cushion apparatus 10 to provide a resilient structure. The cushion apparatus 10 also includes a cushion cover member 40 encasing the resilient spring member 20 associated with the cushion apparatus, that is configured to provide a comfortable surface for the user. FIGS. 1 and 8 illustrate a cushion apparatus 10 and FIGS. 2-7 illustrate the resilient spring member 20, in accordance with embodiments of the invention.

Figure 2:
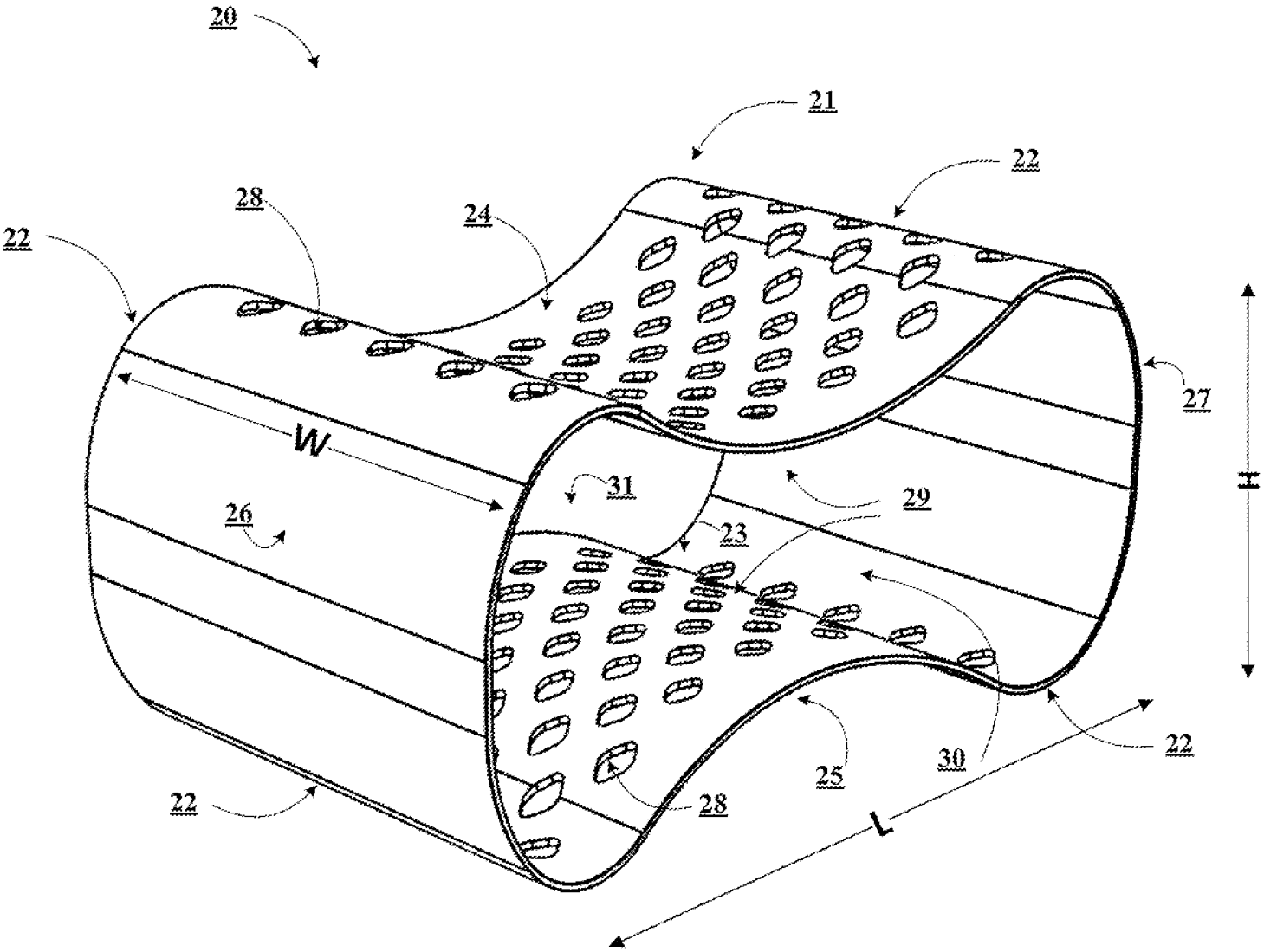
FIG. 2 illustrates a top, left-side perspective view of a resilient spring member of the cushion apparatus of FIG. 1, in accordance with one embodiment of the invention.

Referring now to FIG. 2, the resilient spring member 20 includes a body 21. The body 21 of the resilient spring member 20 may be manufactured from metals (e.g., aluminum, titanium, nickel titanium, steel or an alloy thereof), plastics, composites, polymers, non-metals and the like, either singularly or in combination. For example, the body 21 may be manufactured out of a material chosen for its flexibility and reduced weight properties. In one embodiment, extruded plastics such as polyvinyl chloride or polyethylene, or other substantially rigid or semi-rigid materials having a yield strength sufficiently high to accommodate the anticipated stress that may be applied to the cushion apparatus 10 during use, while resisting permanent deformation. In this way, the body 21 is structured to have sufficient resiliency or elasticity so as not to permanently or plastically deform and while providing a desirable flexibility to provide comfort to the user. The resilient spring member 20 may be configured to have a uniform thickness throughout the body 21. In alternative embodiments, the body 21 may be constructed to have varying thickness, for example, the thickness may be varied such that the body is thicker in areas subject to greater stress and/or less thick in areas requiring greater flexibility.

In one embodiment, the body 21 may be formed into a continuous profile during the manufacturing process. For example, for a body 21 constructed of plastic, the body can be injection molded in a single mold. In other embodiments, the body 21 may be formed by securing or attaching multiple individual sections, such as by gluing, ultrasonic welding, heat sealing, etc. to form a substantially continuous profile. In alternative embodiments, the body 21 may be configured to have a non-continuous profile, such as the profile illustrated in FIGS. 4 and 5.

The body 21 generally defines a length L, width W, and height H. In one embodiment, the length L, the width W, and the height H of the body 21 may be substantially consistent throughout the form of the body 21. In other embodiments, at least one of the length L, the width W, and the height H of the body 21 may vary along the form of the body 21. For example, the height H of the body may be greatest proximate a left lateral side 26 and smallest along a right lateral side 27. Therefore, the body 21 may comprise a tapered height from the left lateral side 26 to the right lateral side 27. Thus the body 21 may have a downward slope from the left lateral side 26 to the right lateral side 27. As another example, the height H of the body 21 may vary along the length L such that, the body 21 may comprise a greater height proximate the left and right lateral sides (26, 27) with a lesser height near a central region of length L.

Figure 3:
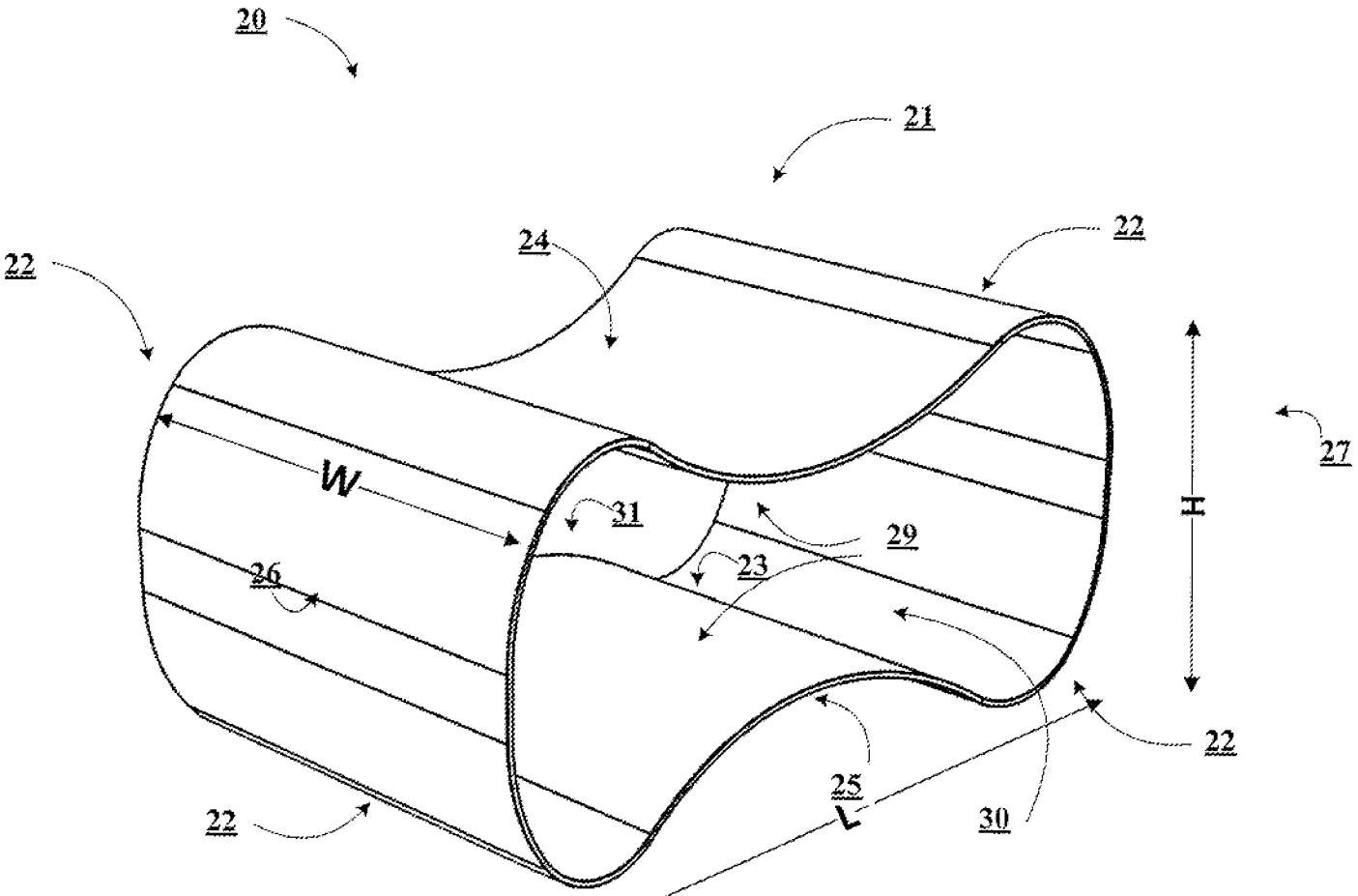
FIG. 3 illustrates a top, left-side perspective view of a resilient spring member of the cushion apparatus of FIG. 1, in accordance with one embodiment of the invention.
Figure 4:
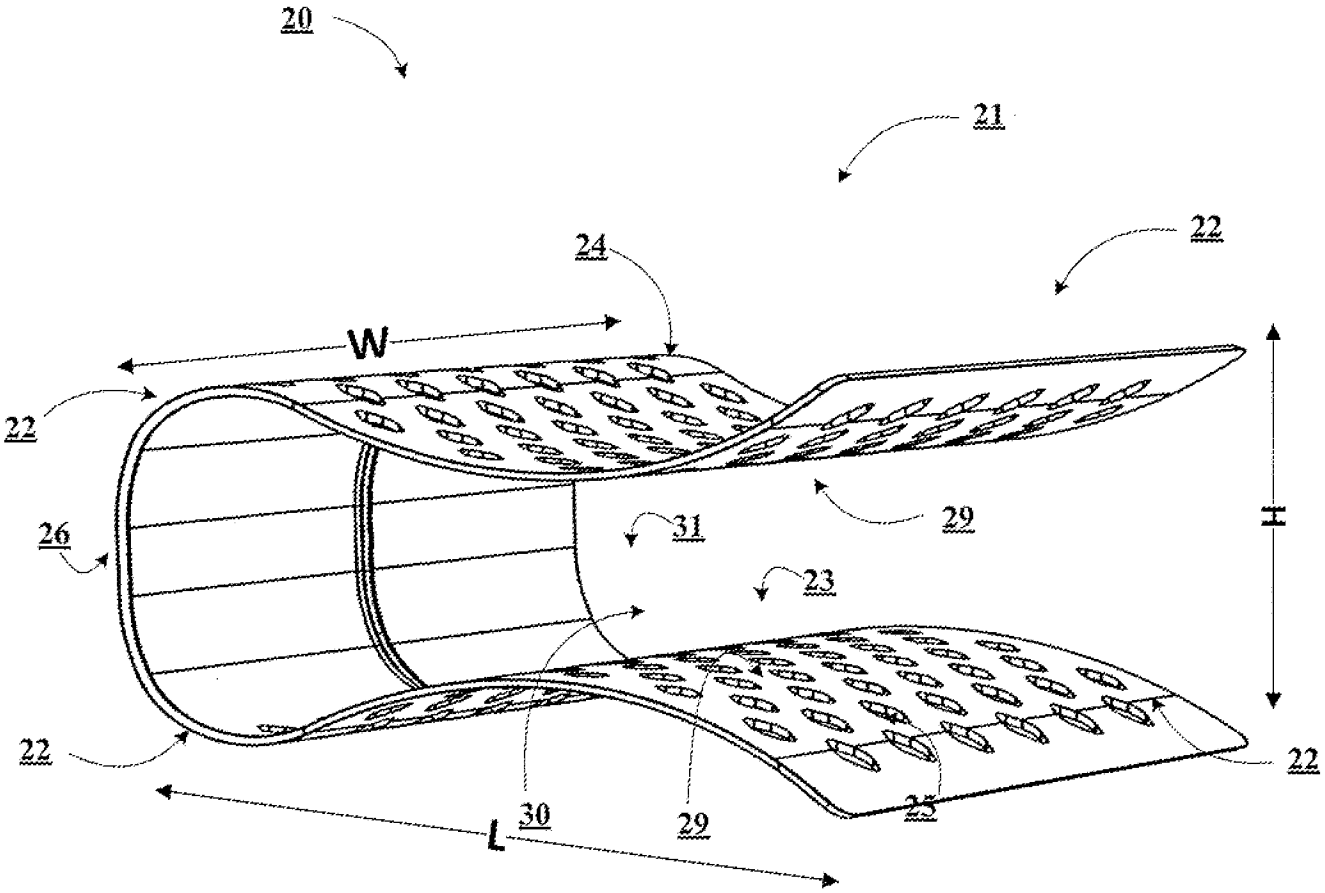
FIG. 4 illustrates a right-side perspective view of a resilient spring member of the cushion apparatus of FIG. 1, in accordance with one embodiment of the invention.
Figure 5:
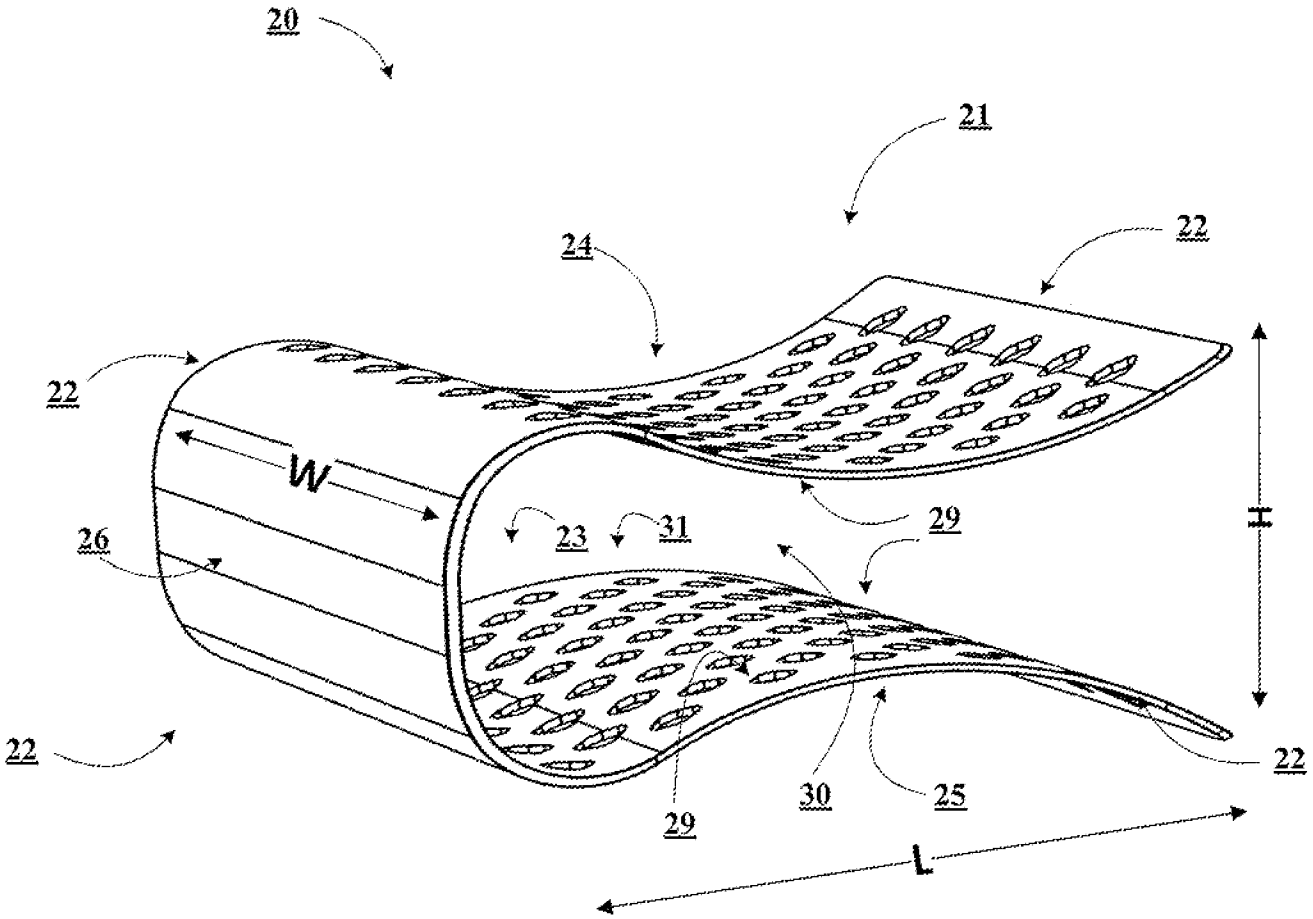
FIG. 5 illustrates a left-side perspective view of the resilient spring member of FIG. 4.
Figure 6:
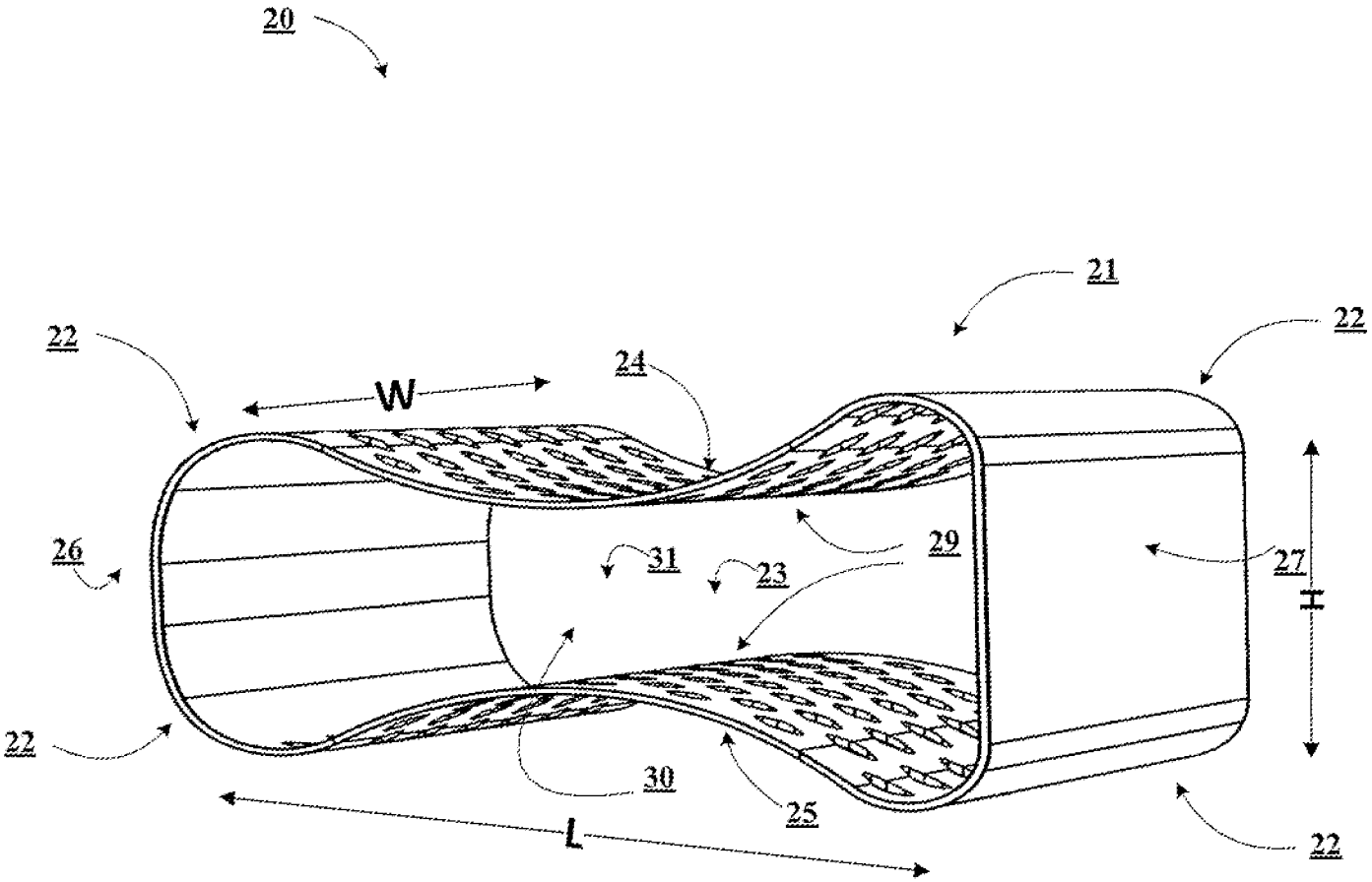
FIG. 6 illustrates a right-side perspective view of a resilient spring member of the cushion apparatus of FIG. 1, in accordance with one embodiment of the invention.

In one embodiment, as illustrated in FIGS. 2 and 3, the body 21 comprises a plurality of contoured or curvilinear surfaces 22 and a hollow interior 23. The body 21 also defines a first surface 24, a second surface 25, a left lateral side 26, and right lateral side 27. In one embodiment, as illustrated in FIGS. 4 and 5, the body 21 defines a first surface 24, a second surface 25, a left lateral side 26, but no right lateral side. At least one of the first surface 24 and/or second surface 25 may comprise a recess or contoured indentation 29. As shown in FIGS. 2 and 3, the recess or contoured indentation 29 may be a depression formed on the first surface 24 and/or the second surface 25 of the body 21 in such a way that the depression extends inwards into the hollow interior 23 of the body 21 towards a central region of the body 21 resulting in a configuration resembling an hour glass or peanut. The invention is not limited to any particular shape for the body 21 and may vary depending on the size of the user and a specific use for the cushion apparatus 10. For example, the body 21 may have a higher degree of curvature (i.e., deeper recess or contoured indentation 29) for the contoured or curvilinear surfaces 22 for a leg pillow to accommodate, receive and/or support the user's popliteal fossa and triceps surae over the contoured or curvilinear surfaces 22 and the first surface 24 and provide ergonomic support.

At least one of the first surface 24, second surface 25, the left lateral side 26, and the right lateral side 27 may include one or more apertures 28. In one embodiment, the apertures are distributed over the surface to enable heat transfer away from the user into the hollow interior 23 where the heat can ventilate through the lateral openings 30 and 31, as discussed in more detail below. The air passages created by the distribution of the plurality of apertures 28 regulate the temperature for the comfort of the user and aid in the dissipation of body heat developed within the cushion apparatus 10 over time during use. In one embodiment, the plurality of apertures 28 are distributed uniformly over the at least one of the first surface 24, the second surface 25, the left lateral side 26, and/or the right lateral side 27 of the body 21. In other embodiments, the plurality of apertures 28 are distributed in a suitable pattern over the at least one of the first surface 24, the second surface 25, the left lateral side 26, and/or the right lateral side 27 of the body 21 based on the length L, width W, and height H of the body 21. Advantageously, not only do the apertures 28 enable heat transfer from the user and ventilation of air, but the apertures reduce the amount of material necessary to form the body 21 thus saving money in manufacturing costs and, further, can be used to adjust the elasticity of certain areas of the body. In other words, areas of the body 21 requiring greater rigidity can be provided with no or fewer apertures than areas requiring greater flexibility.

As shown in FIGS. 2 and 3, the body 21 may also comprise a first lateral opening 30 and a second lateral opening 31 to further aid in the ventilation. In one embodiment, the first lateral opening 30 and the second lateral opening 31 may be at least partially enclosed. In another embodiment, the first lateral opening 30 and the second lateral opening 31 may not be enclosed. In yet another embodiment, the first lateral opening 30 and the second lateral opening 31 may be detachably enclosed with a cover member that is structured to be connected and disconnected by the user to the cushion cover member 40 and/or body 21 (e.g., using an adhesive, a mechanical fastener, such as a zipper or a loop and hook fastener, snaps, etc.).

Figure 7:
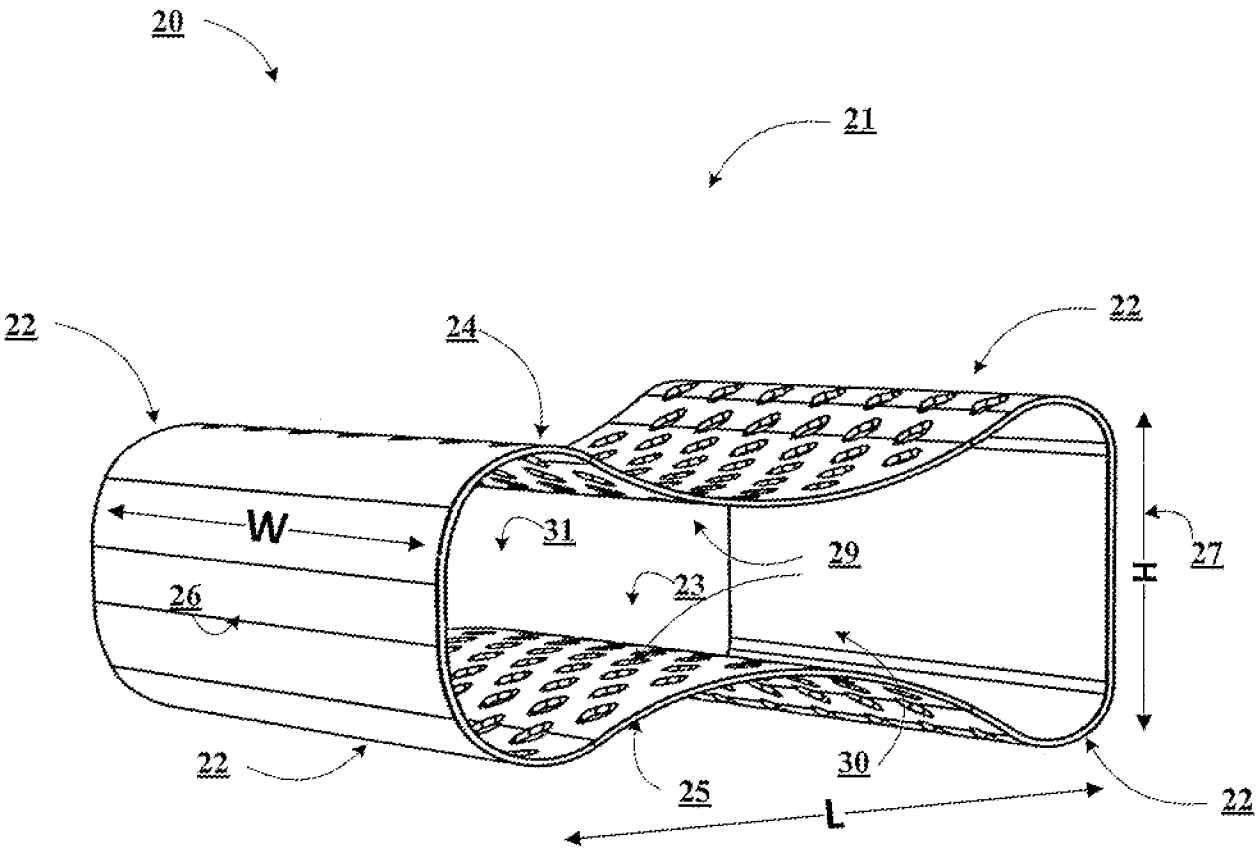
FIG. 7 illustrates a left-side perspective view of a resilient spring member of the cushion apparatus of FIG. 1, in accordance with one embodiment of the invention.
Figure 8:
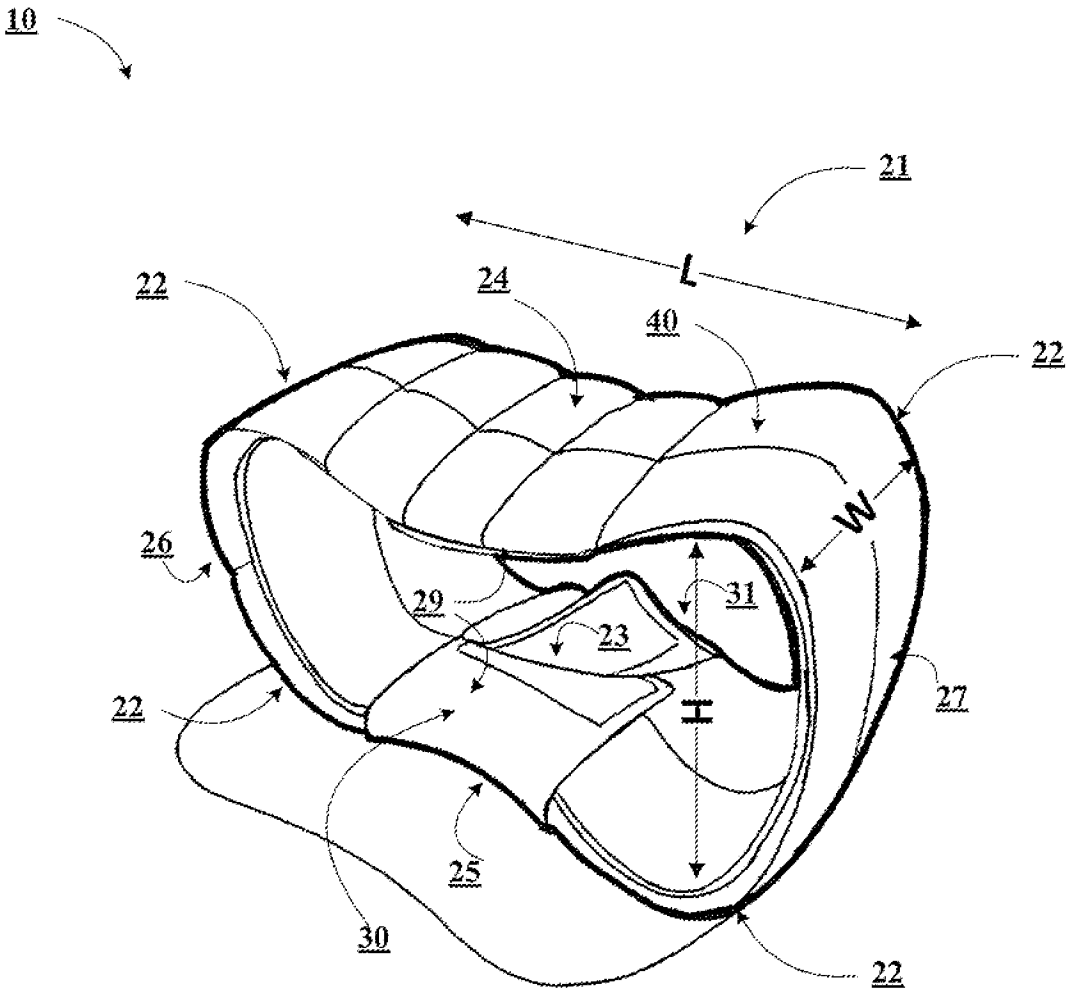
FIG. 8 illustrates a top, front-side perspective view of a resilient spring member encased by a cushion cover member, in accordance with one embodiment the invention.

In one embodiment, as illustrated in FIG. 7, the interior hollow 23 of the body 21 can include one or more reinforcing members 36 to provide additional structural support to the recesses or contour indentations 29. In some embodiments, the reinforcing members may extend between at least two of the first surface 24, the second surface 25, the left lateral side 26, and/or the right lateral side 27 of the body 21.

Referring now to FIG. 8, the cushion apparatus 20 also includes a cushion cover member 40 that can be constructed using a variety of materials, including synthetic and natural fabrics and natural/synthetic blends. For purpose of example, and not limitation, the cushion cover member 40 may be constructed of polyester or silk or cotton fibers having a thermoplastic or other liquid impervious coating. In one embodiment, the cushion cover member 40 is at least partially constructed of a spacer fabric, also commonly referred to as 3-D mesh. Spacer fabrics have a sandwich construction featuring multiple layers to form openings that enable air and liquid to flow through the layers, thereby ventilating the pillow with cool air and to allow moisture to dissipate efficiently. In one embodiment, the spacer fabric is approximately 2 to 3 millimeter in thickness and provides a level of comfort between the resilient spring member 20 and the user.

In some embodiments, the cushion cover member 40 is manufactured using "pillow-filling material". In embodiments where the pillow-filling material includes foam, the foam may be high resilient ("HR") urethane foam. In other embodiments, pillow-filling material may include wool, feather, cotton, polyester, fiber, other synthetic material, fluid, or the like, or any combination thereof. As used herein, a fluid refers to a substance that has no fixed shape and yields easily to external pressure. Therefore, a fluid includes a liquid, a gas, or any combination thereof. The cushion cover member 40 is not limited to any type of pillow-filling material, provided the material provides the desired level of support, ventilation, and/or resiliency and/or comfort to the user.

In one embodiment, the cushion cover member 40 includes multiple indentation load deflection (ILD) areas therein with varied pounds of force required to indent the areas of the cushion cover member 40 by a percentage of its thickness. The ILD is a measure of how much pressure it takes to compress the foam twenty-five percent (25%) of its thickness. For instance, if a pillow is 4" thick and has an ILD rating of 33, it would take 33 pounds of pressure to condense the foam to a thickness of 3". In terms of user comfort, the load-deflection characteristics of the cushion cover member 40 and spring member 20 dictate the softness of the cushion apparatus 10 and the ability of the cushion apparatus 10 to elastically yield readily to its initial load. As such, the cushion cover member 40 may include multiple ILD areas with varying levels of softness to provide comfort to the user. In one embodiment, the ILD on various areas of the cushion cover member 40 may be based on the overall shape of the body 21. In another embodiment, the ILD on various areas of the cushion cover member 40 may be based on the number of apertures 28 on a specific surface area of the body 21. In alternate embodiments, the ILD on various areas of the cushion cover member 40 may be based on the thickness defined by a specific surface area of the body 21. In this way, the ILD areas are customizable to provide an adequate level of comfort to the user.

Typically, in some embodiments, the cushion cover member 40 is at least partially attached to one or more of the first surface 24, the second surface 25, the left-lateral surface 26, and/or the right-lateral surface 27 of the body 21 (except in the embodiments of the resilient spring member 20 does not include a right-lateral surface 27, such as the embodiment illustrated in FIGS. 4 and 5, no connection to the right-lateral surface 27 is made). In one embodiment, at least a portion of such attachment is configured to be detached (e.g., zippered, buttoned, snapped, hook and loop fastened, etc.) so that the interior of the cushion cover member 40 can be accessed to allow the resilient spring member 20 to be replaced. In one embodiment, as illustrated in FIG. 8, the cushion cover member 40 may at least partially enclose the first surface 24, the second surface 25, the right-lateral surface 26, and the left-lateral surface 27. For embodiments such as the one illustrated in FIGS. 4 and 5, the cushion cover member 40 may at least partially enclose the first surface 24, the second surface 25, and/or the left-lateral surface 27 and extend between the first surface 24 and the second surface 25 on the right later side of the body 21. For cushion cover members 40 made of multiple pieces, the pieces may be attached using any one of a variety of known methods, including, without limitation, sewing, gluing, ultrasonically welding, heat sealing, zippering, hook-and-loop fastening, buttons, snaps, buckles or the like. For example, the cushion cover member 40 may be formed from four pieces of material, each of which substantially forms one of the four surfaces of the body 21 of the resilient spring member 20. Alternatively, any single piece may form part of or all of the one or more surfaces body 21. Also, it follows that a single piece may be formed and its edges attached to itself so that the cushion cover member 40 consists of a single piece and any attachment mechanisms. It is to be understood that some pieces of the cushion cover member 40 may overlap other pieces. The cushion cover member 40 may include one or more cover apertures or openings to allow access to the interior hollow 23 and the resilient spring member 20. The cover aperture or opening may include a zipper that runs along an edge of the cushion cover member 40 such that when the zipper is opened, the cushion cover member 40 is positioned to accept the resilient spring member 20. When the zipper is closed, the resilient spring member 20, in one embodiment, completely enclosed within the cushion cover member 40. Alternatively, the cover aperture or opening can take many different forms, including a surface that has one or more of its edges attached to the other surfaces by hook-and-loop fasteners, snaps, buttons, buckles, or any other fastening or enclosing mechanism.

Optionally, the pillow may include a cover (not shown) at least partially enclosing the cushion cover member 40 and/or the resilient spring member 20. For covers made of multiple pieces, the pieces may be attached using any one of known methods, including, without limitation, sewing, gluing, ultrasonically welding, heat sealing, zippering, hook-and-loop fastening, buttons, snaps, buckles or the like.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation. In addition, where possible, any terms expressed in the singular form herein are meant to also include the plural form and/or vice versa. As used herein, "at least one" shall mean "one or more" and these phrases are intended to be interchangeable. Accordingly, the terms "a" and/or "an" shall mean "at least one" or "one or more," even though the phrase "one or more" or "at least one" is also used herein.

What is claimed is:

1. A cushion apparatus, comprising:

a resilient spring member, the resilient spring member having first and second edges and further comprising:

a first surface, a second surface, and a left-lateral surface, wherein the first surface, second surface, and left-lateral surface define an interior hollow and a medial plane extending through the interior hollow and midway between the first and second surfaces of the resilient spring member, wherein the first surface and second surface define contoured indentations that are generally symmetrical about the medial plane, wherein the contoured indentations extend into the interior hollow, and wherein the first edge and the second edge of the resilient spring member each form a contoured indented opening into the interior hollow; and a cushion cover member at least partially enclosing the first surface, the second surface and the left-lateral surface of the spring member.

2. A cushion apparatus according to claim 1, further comprising a right-lateral surface, and wherein the first surface, second surface, left-lateral surface and right-lateral surface define the interior hollow.

3. A cushion apparatus according to claim 1, wherein at least one of the first surface, second surface, and left-lateral surface define at least one aperture.

4. A cushion apparatus according to claim 1, wherein the resilient spring member is formed of plastic.

5. A cushion apparatus according to claim 1, wherein the resilient spring member is formed of metal.

6. A cushion apparatus according to claim 1, wherein the cushion apparatus further comprises one or more reinforcing members positioned within the interior hollow.

7. A cushion apparatus according to claim 1, wherein the resilient spring member defines a cushion height between the first surface and the second surface, wherein the cushion height varies along a length of the resilient spring member.

8. A cushion apparatus according to claim 1, wherein the cushion cover member comprises at least one cover aperture configured to allow access to the interior hollow of the resilient spring member.

9. A cushion apparatus according to claim 1, wherein the cushion cover member comprises spacer fabric.

10. A cushion apparatus according to claim 1, wherein the cushion cover member comprises high-resilient urethane foam.

11. A cushion apparatus according to claim 1, wherein the cushion apparatus further comprises a cover at least partially enclosing the cushion cover member and the resilient spring member.

12. A cushion apparatus according to claim 1, wherein the cushion apparatus is configured to allow heat transfer from an exterior of the cushion apparatus to the interior hollow.

13. A cushion apparatus according to claim 1, wherein the cushion apparatus is configured to allow circulation of air within the cushion apparatus and ventilation of heat away from the cushion apparatus.

* * * * *